US005709063A

United States Patent [19]

Yuyama et al.

[11] Patent Number: 5,709,063

[45] Date of Patent: Jan. 20, 1998

[54] TABLET PACKING MACHINE

[75] Inventors: Shoji Yuyama; Hiroshi Nose; Takaaki Murakami, all of Toyonaka, Japan

[73] Assignee: Kabushiki Kaisha Yuyama Seisakusho, Toyonaka, Japan

[21] Appl. No.: 522,490

[22] Filed: Aug. 31, 1995

[30] Foreign Application Priority Data

Sep. 1, 1994 [JP] Japan ..... 6-208787
Oct. 13, 1994 [JP] Japan ..... 6-248055

[51] Int. Cl.[6] ..... B65B 35/54

[52] U.S. Cl. ..... 53/154; 53/168; 53/237

[58] Field of Search ..... 53/154, 168, 237, 53/501, 443, 900, 473

[56] References Cited

U.S. PATENT DOCUMENTS 3,061,990 11/1962 Lakso ..... 53/237
3,871,156 3/1975 Koenig et al. ..... 53/501

FOREIGN PATENT DOCUMENTS 2-205523 8/1990 Japan .
2-269601 11/1990 Japan .
4-44904 2/1992 Japan .
6-64601 3/1994 Japan .
WO94/12393 6/1994 WIPO ..... 53/154

*Primary Examiner*—Linda Johnson
*Attorney, Agent, or Firm*—Wenderoth, Kind & Ponack

[57] ABSTRACT

A device and a method for continuously packing tablets in which the refilling of tablets can be done without stopping the device. The tablet packing machine has a case housing a plurality of tablet feeders. The case is also provided with backup tablet feeders and backup discharge channels through which tablets discharged from the backup tablet feeders are dropped into a hopper in the tablet packing machine. The backup tablet feeders are filled with tablets beforehand. When the stock of tablets in one or some of the tablet feeders decreases to a predetermined level, the backup tablet feeders containing the same kind or kinds of tablets are activated to discharge tablets from these backup feeders. Thus, it is possible to continuously discharge tablets and thus to pack tablets continuously without interruption.

12 Claims, 17 Drawing Sheets

TABLET PACKING MACHINE

BACKGROUND OF THE INVENTION

The present invention relates to a continuous tablet packing machine and a method for continuously and automatically packing prescribed tablets in separate pouches.

FIGS. 15 and 17 show conventional automatic tablet packing machines 1 of this type.

These tablet packing machines 1 comprise a plurality of tablet feeders 3 arranged along vertical discharge channels 2, a control device for controlling the individual tablet feeders 3 based on prescription data, a hopper 6 provided under the discharge channels 2 to collect tablets T discharged from the feeders 3, and a packer 7 for putting the tablets in separate pouches as prescribed.

Namely, the tablet packing machine 1 shown in FIG. 15 has a plurality of right and left pairs of drawer units 9 mounted in a box-shaped case 8. The drawer units 9 are slidably supported by upper guide units 10 and lower guide units 11. They can be pulled out through openings 13 formed by opening doors 12.

Each upper guide unit 10 comprises longitudinally extending rails disposed over the drawer units 9, and a plurality of rollers located on both sides of the rails and mounted to the bottom surface of the top wall of the case 8. Each lower guide unit 11 comprises a rail mount secured to lower portions of the drawer units 9, a rail mount secured in the case 8, and slide rails mounted on both rail mounts.

Each drawer unit 9 has a plurality of tablet feeders 3 that are arranged in right and left vertical rows Each tablet feeder 3 comprises, as shown in FIG. 16, includes a motor base 14 and a cartridge 15 detachably mounted on the motor base 14. A rotor 16 is mounted in the cartridge 15. By rotating the rotor 16 with a motor mounted to the motor base 14, tablets T stored in the cartridge 15 slide into pockets formed in the rotor 16 along its outer circumference. The tablets T in the pockets 17 are discharged one by one from a discharge port 18 formed in a support member.

Each drawer unit 9 is formed with a vertical discharge channel extending between the right and left rows of tablet feeders 3. The tablets T discharged from the respective tablet feeders 3 are collected into the underlying common hopper 6. An unillustrated control device activates a selected one of the tablet feeders 3 based on the prescription data to discharge tablets T in the selected feeder 3 through its discharge port 18 and the discharge channel 2 into the hopper 6. The tablets are then put in separate pouches by the packer 7.

On the other hand, the device shown in FIG. 17 comprises an outer drum 19 and an inner drum 20 fitting in the outer drum. As shown in FIG. 17, the inner drum 20 and the outer drum 19 comprise a plurality of square tubular members arranged into a cylindrical shape. Each square tubular member 21 is formed with a discharge channel 2 at its radially inner side thereof.

As shown in FIG. 18, the outer drum 19 has an axial slit 22 through which the inner drum 20 can be seen. The outer drum 19 carries annular plates 23 on its top and bottom. The annular plates 23 are rotatably supported by rollers 24 mounted on support plates 25 to support drums 19, 20. On the other hand, the inner drum 20 carries disks 26 on its top and bottom. The upper disk 26 is supported by rollers 24 mounted on the upper annular plate 23. Rollers 24, mounted on the lower disk 26 along its circumference are supported by the lower annular plate 23 of the outer drum 19.

The drums 19 and 20 carry on the outer cylindrical surface thereof a plurality of tablet feeders 3 of the same type shown in FIG. 16 which are arranged in vertical and circumferential rows. Tablets T, discharged from the tablet feeders 3 through their discharge ports 18, pass through windows 27 formed in the outer walls of the square tubular members 21 and drop through the discharge channels 2, then through holes 28 formed in the lower disk 26 or annular plate 23 and communicating with the bottoms of the discharge channels 2, and collect into the hopper 6.

Similar to the arrangement of FIG. 15, a control device activates a selected one of the tablet feeders 3 according to the prescription data to feed tablets T in the selected feeder to the hopper 6 through the discharge channel 2. The tablets collected in the hopper are put in separate pouches by the packer 7 provided under the hopper 6.

In order to initially supply or resupply tablets T into the respective tablet feeders 3 in the drawer type tablet packing machine 1 shown in FIG. 15, an operator has to pull the drawer units 9 out of the case 8, take the cartridges 15 out of the tablet feeders 3, fill tablets T into the cartridges 15, return the cartridges 15 into the feeders 3, and push the drawer units 9 back into the case 8.

In the case of the drum type machine shown in FIG. 17, there is a slight difference between the ways in which tablets are supplied into the tablet feeders 3 mounted on the outer drum 19 and those mounted on the inner drum 20. When supplying tablets into the feeders on the outer drum 19, the cartridges 15 are taken out after rotating the outer drum 19 to move the respective feeders 3 to the position at which tablets can be supplied into the cartridges, and then tablets T are supplied into the cartridges 15 thus taken out. On the other hand, when supplying tablets to the feeders mounted on the inner drum 19, the inner drum 19 is turned to move the respective tablet feeders 3 into juxtaposition with the slit 22 of the outer drum 19. Then, the cartridges 15 are taken out of the respective tablet feeders 3, and tablets T are supplied into the cartridges.

Each tablet feeder of these tablet packing machines can accommodate only a limited number of tablets at a time. Also, only a limited number of tablet feeders can be mounted on the machine. These facts lead to the following problems:

(1) Since each tablet feeder can accommodate only a rather limited number of tablets at a time, the machine has to be stopped frequently to resupply tablets into the tablet feeders. This worsens the operating efficiency of the machine.

Namely, in the case of the drawer type machine shown in FIG. 15, while the drawer units 9 are being pulled out of the case 8, the discharge channels 2 are moved out of alignment with the hopper 6, so that it is impossible to drop tablets T into the hopper 6. Thus, the entire machine 1 has to be stopped in this state.

On the other hand, with the drum type machine shown in FIG. 17, the drums 19, 20 are rotated, so that the discharge channels 2 rotate around the hopper 6. Thus, it is possible to discharge tablets T from the tablet feeders 3 while the drums 19, 20 are being rotated for refilling the feeders with tablets. But if discharge signals are given to the tablet feeders 3 while refilling, it becomes impossible to discharge tablets T. Namely, the device 1 has to be stopped.

(2) While the number of tablet feeders 3 that can be mounted on such machines is limited, the kinds of drugs prescribed in today's hospitals are increasing at a rapid pace. Thus, it is often difficult to store all the necessary prescription tablets in the machine 1. Namely, it is usually impossible to store tablets that are less frequently prescribed in the tablet feeders 3. This makes it necessary to replace tablets stored in one or some of the tablets feeders with less frequently prescribed tablets every time these tablets are required in one or some prescriptions. For example, it is necessary to manually set tablets T only in required amounts in a detachable tablet supplier 26 shown in FIG. 19 and then insert this supplier into a slot provided over the hopper 6. During this operation, the device 1 has to be stopped. Namely, it is impossible to continuously pack tablets. The efficiency is thus low.

An object of the present invention is to improve the efficiency of packing frequently prescribed tablets. A second object is to provide an arrangement that makes it possible to continuously pack even less frequently prescribed tablets.

SUMMARY OF THE INVENTION

According to the present invention, there is provided a tablet packing machine wherein a plurality of tablet feeders are arranged along vertically extending discharge channels, wherein a control device activates each feeder based on prescription data, and wherein tablets discharged from the feeders are dropped into a hopper provided under the discharge channels to pack them in separate pouches with a packer according to prescriptions.

The machine is provided with backup tablet feeders and backup discharge channels through which tablets discharged from the backup tablet feeders are dropped into the hopper. The control device activates the backup tablet feeders to discharge tablets from the backup tablet feeders instead of from the tablet feeders when the tablets stored in said tablet feeders are depleted or scarce in amount.

According to the present invention, backup tablet feeders are provided in addition to the tablet feeders in the machine, or part of the tablet feeders in the machine are used as backup tablet feeders. Tablets are stored in such backup tablet feeders beforehand. When the tablets in the tablet feeders run short, tablets are then discharged from the backup tablet feeders. Thus, it is possible to pack tablets continuously without interruption.

The backup tablet feeders may be provided on a location where tablets can be resupplied without pulling out the drawer unit, such as on the outer wall of the case accommodating the drawer units. This arrangement makes it possible to refill the backup tablet feeders before the tablets therein run out without interrupting the packing of tablets.

By using the drawer type tablet feeders, e.g. of the same number as the tablet feeders mounted on the drawer units, it is possible to store in each backup tablet feeder tablets of the same kind as those stored in the corresponding tablet feeder mounted on the drawer units If the tablets in any of the tablet feeders run short, the backup tablet feeder or feeders corresponding to the tablet feeder(s) are activated to discharge tablets from the backup tablet feeders. In this state, the drawer unit carrying the empty tablet feeders is pulled out and tablets are supplied into the tablet feeders. Then, the drawer unit is pushed back into the machine. Now, the tablet feeders are reactivated, after deactivating the backup tablet feeders.

On the other hand, when using the drum type tablet feeders, tablets are e.g. stored in the backup tablet feeders beforehand. When the tablets in the tablet feeders run short, refilling is done while discharging tablets from the backup tablet feeders. Thus, it is possible to pack tablets continuously without interruption.

Other features and objects of the present invention will become apparent from the following description made with reference to the accompanying drawings, in which:

DETAILED DESCRIPTION OF THE PREFERRED EMBODIMENT

Embodiments are now described with reference to the drawings.

In describing the embodiment, the elements already mentioned in the description of the prior art are denoted by the same numerals in the figures and their description is omitted.

Figure 1:
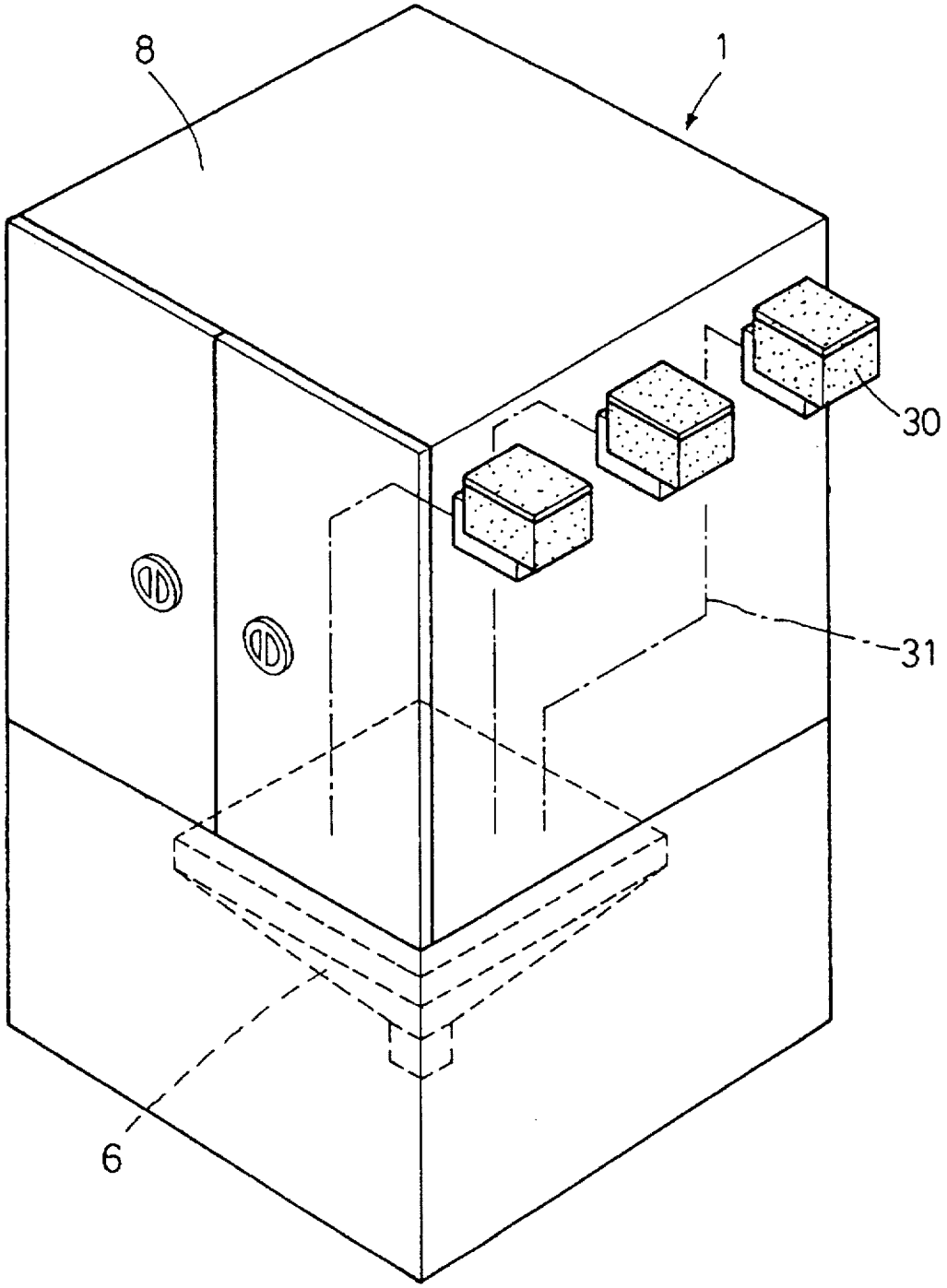
FIG. 1 is a perspective view of a first embodiment.
Figure 2:
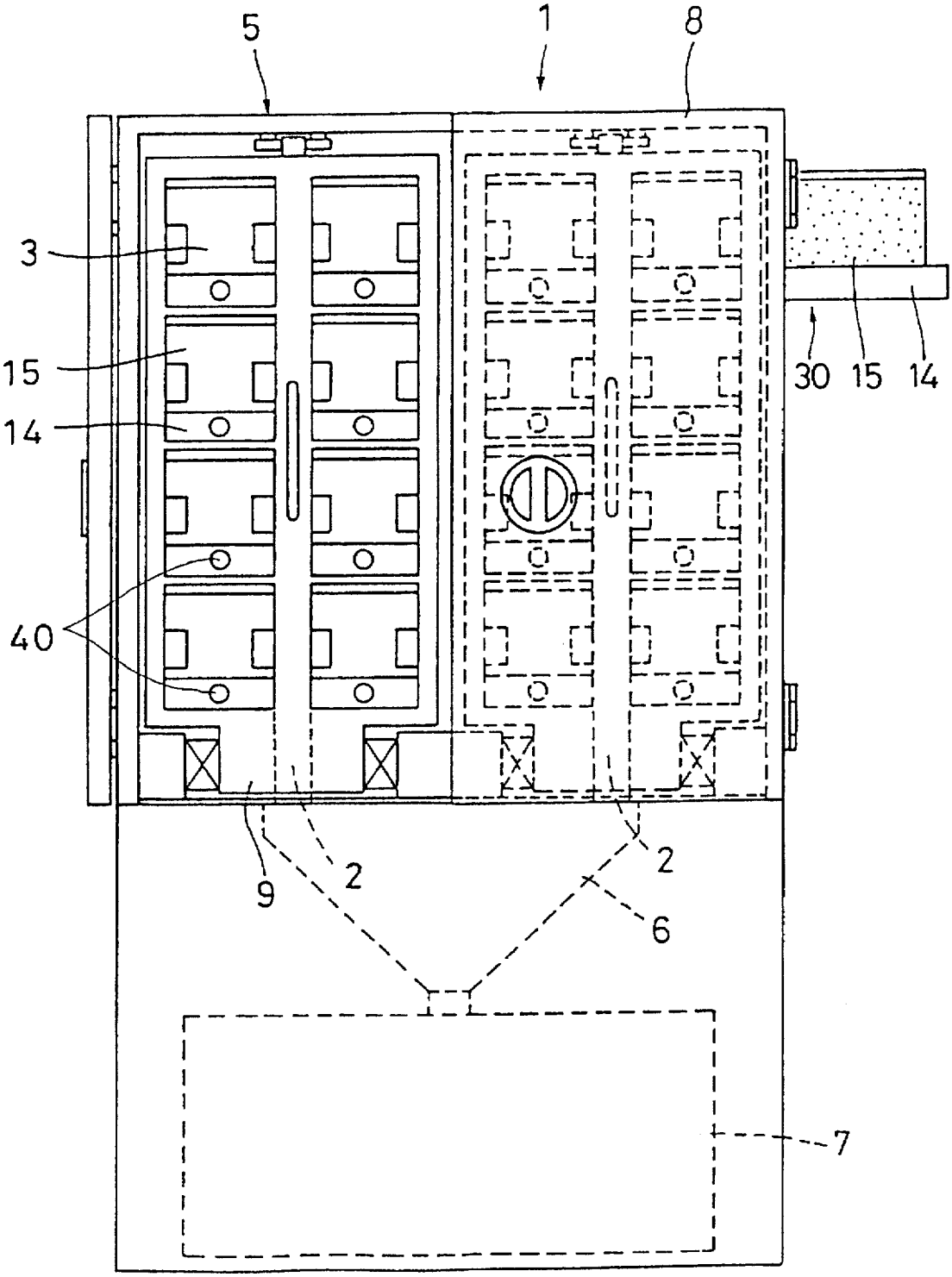
FIG. 2 is a perspective view of a second embodiment.

As a first embodiment, we show in FIG. 1 a drawer type tablet packing machine 1, according to the first and second inventions, provided with backup tablet feeders 30 and backup discharge channels 31. In this case, each backup tablet feeder 30 has its motor base 14 mounted on one side of the case 8 so that the attachment and detachment of a cartridge 15 are possible without pulling out the drawer unit 9. Tablets T discharged from each backup tablet feeder 30 are discharged through the backup discharge channel 31 into the hopper 6.

Figure 3A:
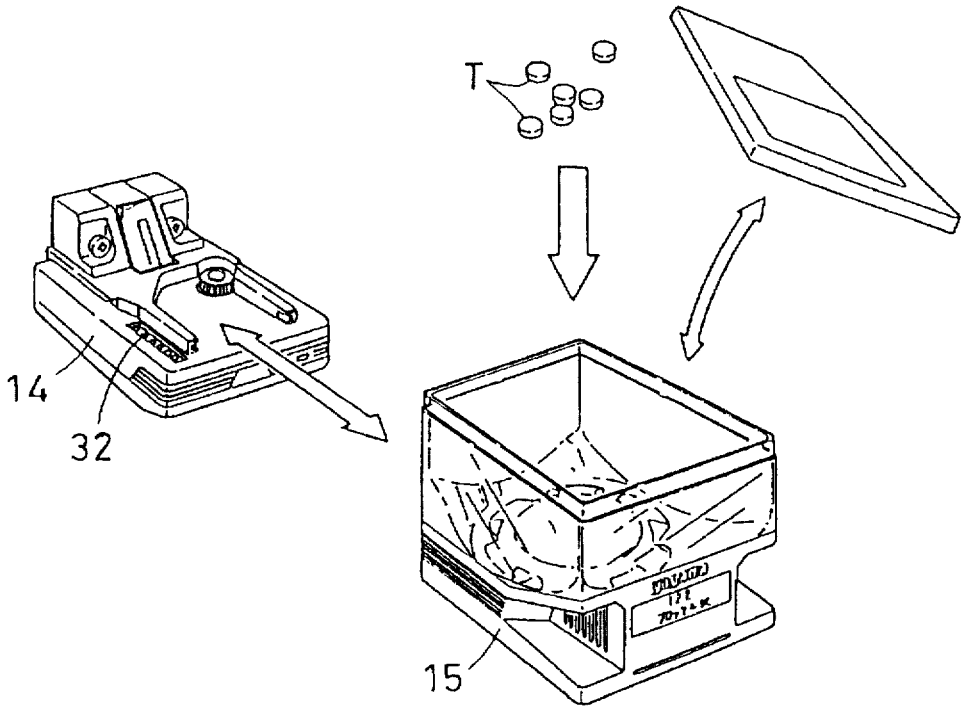
FIG. 3A is an exploded perspective view of a tablet feeder.
Figure 3B:
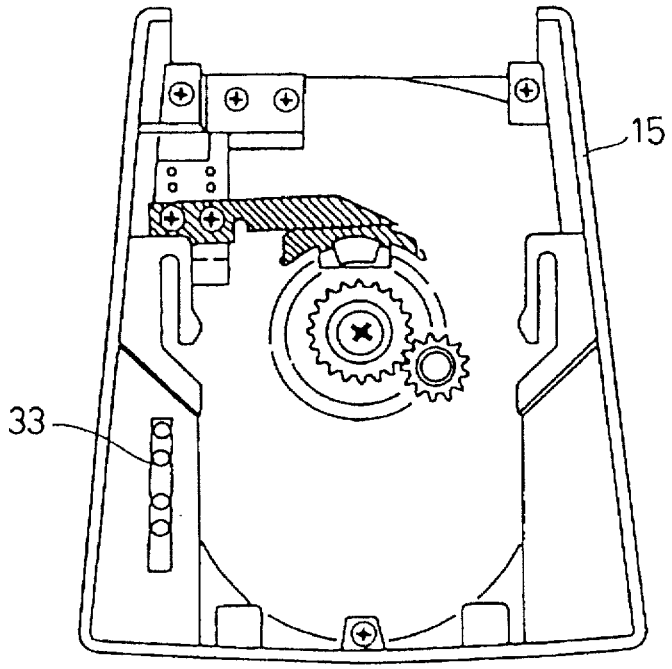
FIG. 3B is a bottom plan view of a cartridge of the tablet feeder shown in FIG. 3A.

Each backup tablet feeder 30 has a means which enables the control device to distinguish the kind of tablets stored. This means comprises a reading means in the form of a plurality of light sensors 32 mounted on the motor base 14 in a row (see FIG. 3A), and an indicator means in the form of a binary-coded marker 33 made up of marks and spaces and stuck on the cartridge 15, as shown in the bottom plan view of FIG. 3B. By mounting the cartridge 15 on the motor base 14, the marker 33 is located opposite the light sensors 32, enabling the light sensors to read the data on the marker 33. This reading means is connected to a control device 4 via an interface as shown by the block diagram of FIG. 4, so that the data read is inputted in the control device 4.

On the other hand, each tablet feeder 3 mounted in the body 5 of the tablet packing device has a display device in the form of a light emitting diode 40 for signaling the permission to resupply tablets.

Figure 4:
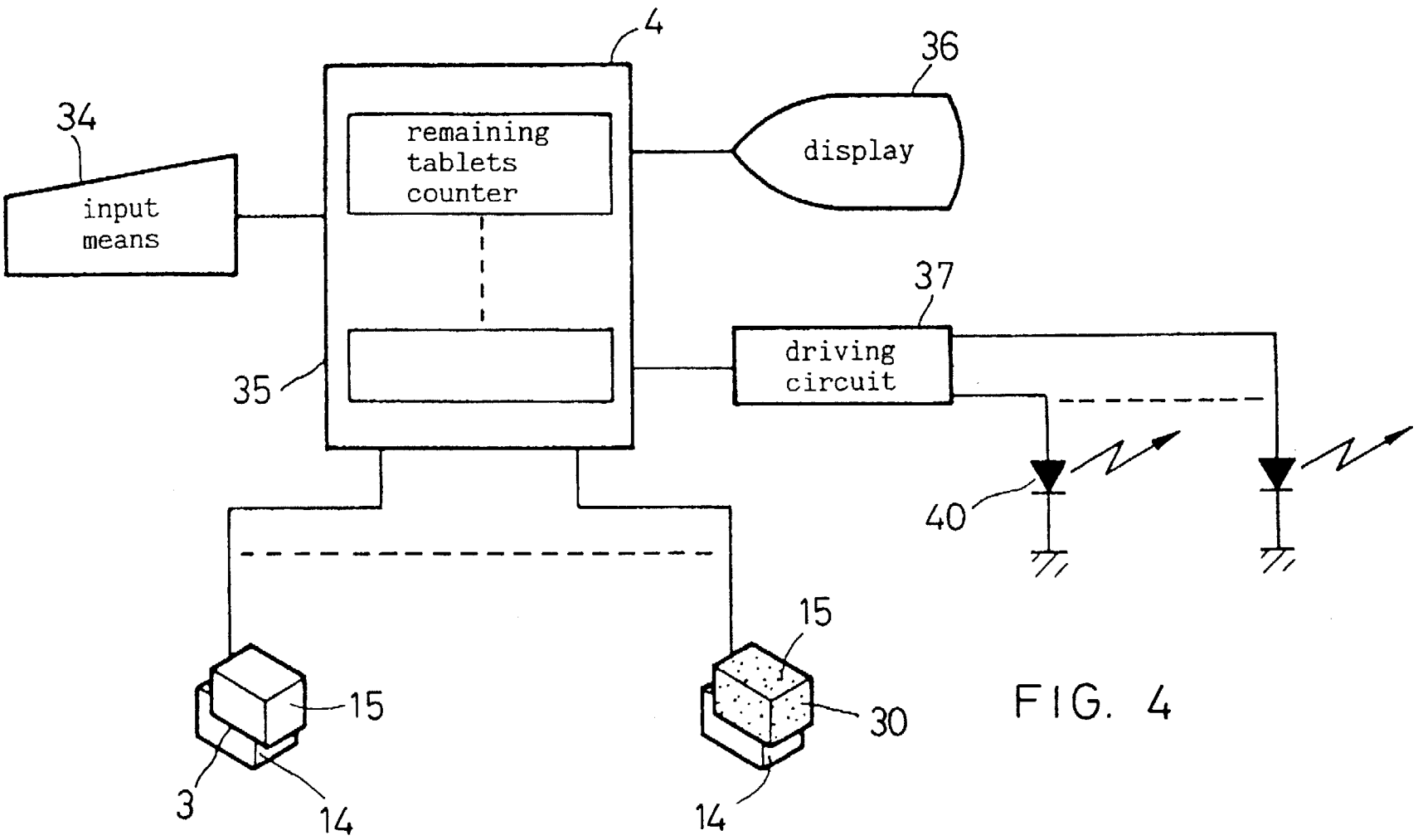
FIG. 4 is a block diagram of the control device.

In this embodiment, each light diode 40 is mounted on the motor base 14 of the respective tablet feeder 30 in the body 5 of the tablet packing machine. As shown in FIG. 4, the light emitting diodes 40 are connected to and controlled by the control device 4 of the tablet packing machine 1 (which will be described later in detail) for controlling the tablet packing procedure.

The control device 4 comprises an input means 34 such as a keyboard for inputting prescription data, a processing unit 35 for executing a tablet packing program (FIG. 5) based on the prescription data inputted, a display device 36 for displaying the number of tablets T remaining in each tablet feeder 3, 30 and the status of the packing process, and a driving circuit 37 for activating the light emitting diode 40 as the display device for indicating the permission to resupply tablets.

The processing unit 35 has a register for counters for counting the numbers of tablets T remaining in the respective feeders 3, 30. The value on each counter is decremented by one each time a detector means provided at the discharge port 18 of the corresponding tablet feeder 3 detects a tablet 5 being discharged. The processing unit 35 automatically sets the number of tablets T to be stored in each feeder 3 in the corresponding counter by weighing each cartridge 15 when mounting it on the motor base 14 of the tablet feeder 3, inputting the weight obtained in an input means 34, and dividing this value by the weight data per tablet read from a data table stored in the processing unit 35 and indicating the weight per tablet for each kind of tablets. This is possible because tablets of the same kind are all of the same weight. The weight data per tablet is automatically read out of the data table by an identification means using the name of the tablets to be read out.

Figure 5:
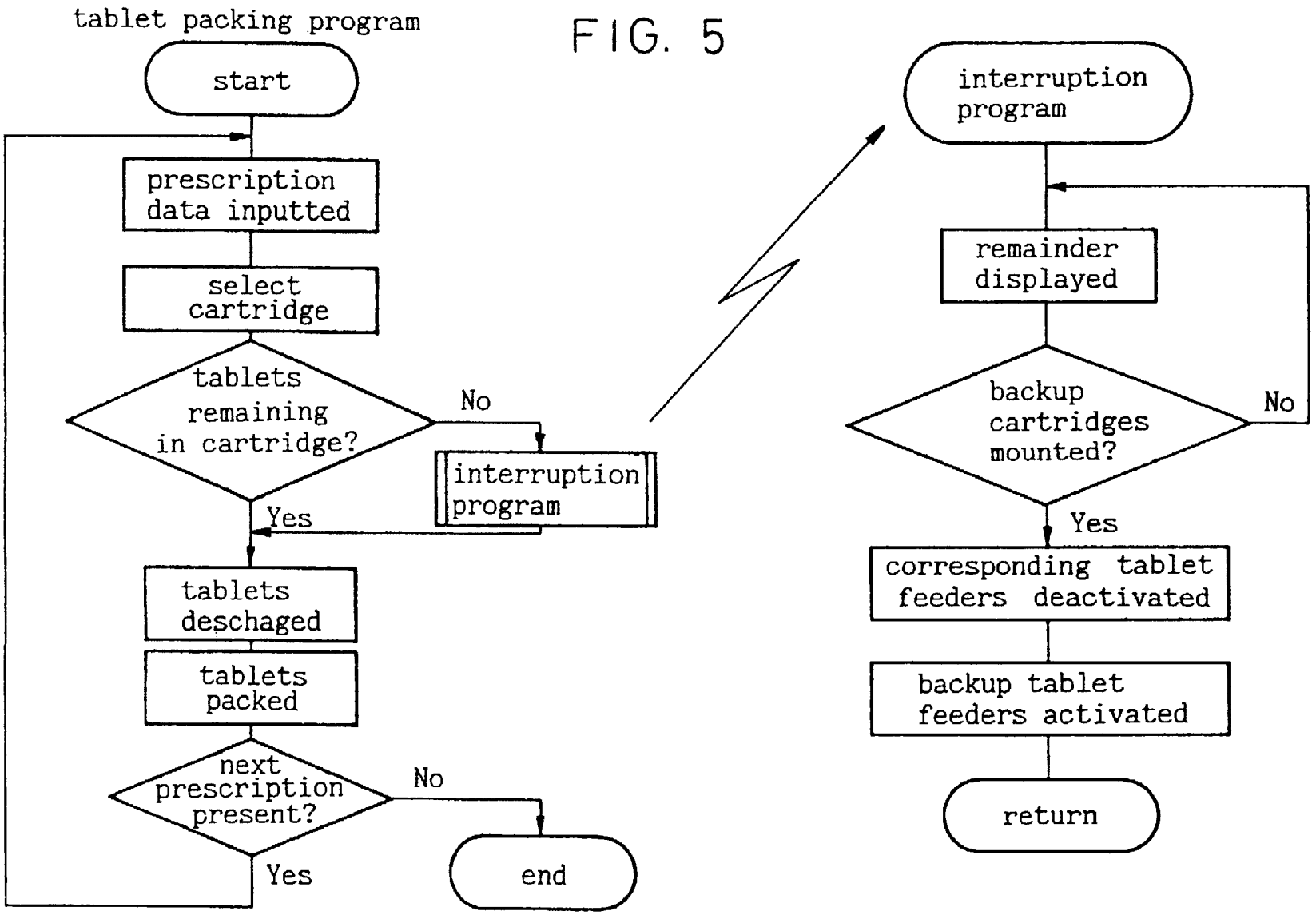
FIG. 5 shows information displayed on the screen of the display device.

In this way, the control device 4 monitors the number of tablets T in each tablet feeder 3, and when the number of the tablets T remaining decreases to a predetermined value, it interrupts the packing program for packing tablets using the tablet feeders 3 and instead executes the interrupt processing program in which the backup tablet feeders 30 are used (FIG. 5). Namely, in this state, tablets are discharged from the backup tablet feeders 30 instead of the tablet feeders 3, whose stock is now low.

At the same time, the driving circuit 37 is activated to turn on the light emitting diodes 40 of the tablet feeders 3 which are now low in the contents of tables T. While the light emitting diode 40 of any of the tablet feeders 3 is turned on, it is possible to take out its cartridge 15 for replenishing of tablets T without the possibility of hindering the tablet packing operation.

When the necessary tablet feeders 3 have been refilled with tablets, the number of tablets resupplied is set in the corresponding counters through the input means 34. Then, tablets T are discharged from the tablet feeders 3 in the body 5 instead of from the backup tablet feeders 30 and packed. At the same time, the driving circuit 37 is deactivated to turn off the light emitting diode 40.

In the embodiment, the tablet distinguishing means comprises the light sensors 32 and the marker 33. But it may be the type that uses a Hall element and the existence and nonexistence of magnets, a lead relay and the existence and nonexistence of magnets, a magnetic means such as a combination of a magnetic head and a magnetic tape, a bar code, a combination of transmitter and a transponder, or a combination of a contact switch and a switch-activating projection.

Having thus far described the structure of the embodiment, we will now describe the method of packing tablets according to the third and fourth inventions by explaining the operation of the embodiment.

Figure 6:
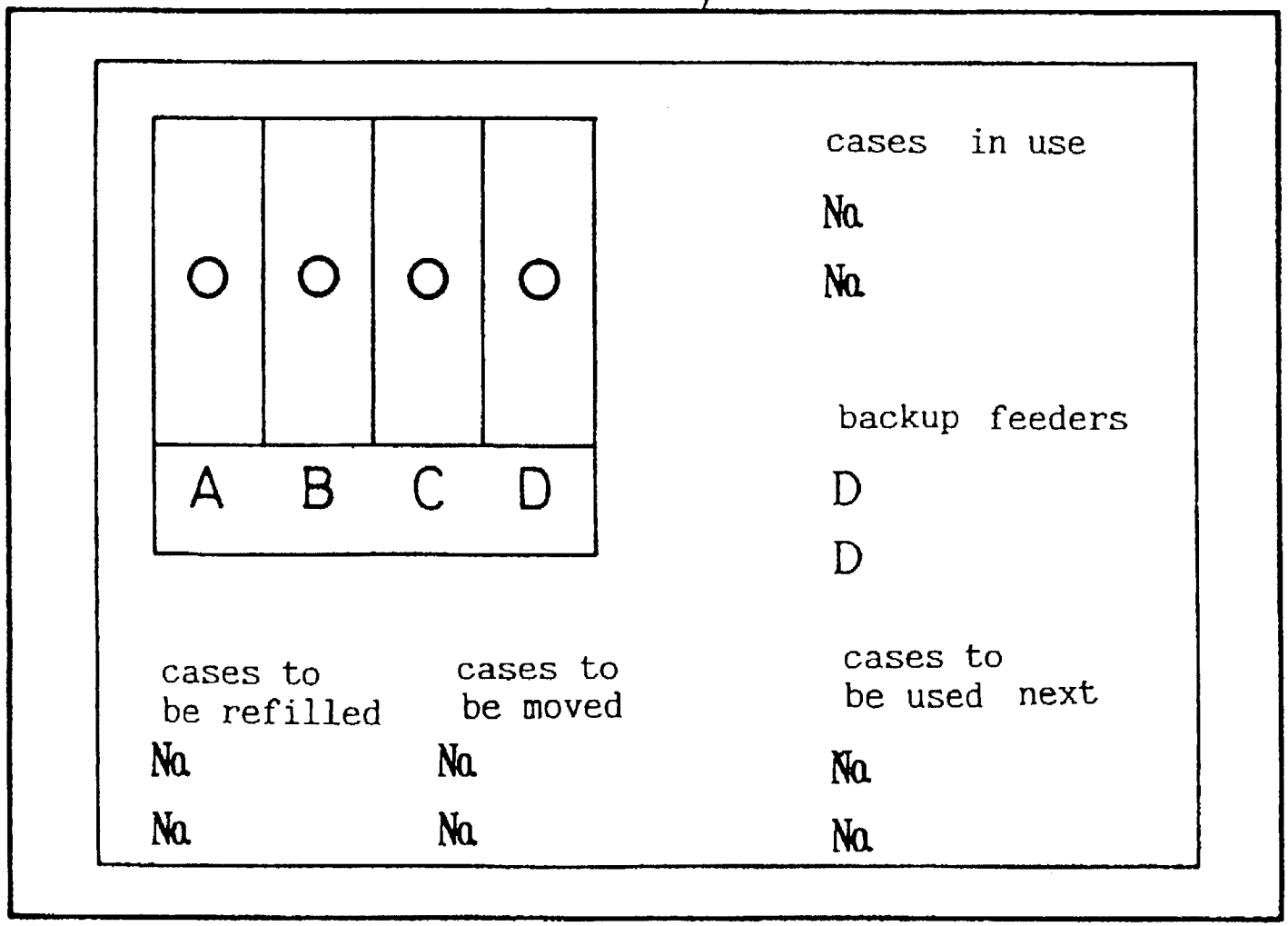
FIG. 6 is a flowchart of the packing processing program.

Tablets T used as prescription drugs are stored in the cartridges 15, and the cartridges 15 are mounted in the tablet feeders 3 of the tablet packing machine 1. A marker 33 that indicates the name of the tablets stored in each cartridge 15 is stuck on the cartridge. Also, when mounting, the cartridge 15 is weighed and its weight is inputted through the input means 34. In this state, the display device 36 is displaying the control sequence and control menu as shown in FIG. 6, so that an operator can input weight data for each cartridge 15 according the instructions on the display.

When tablets T have been stored in the tablet feeders 3, prescription data are inputted through the input means according to prescriptions. The device 1 now starts packing tablets. Namely, the control device 4 starts up a tablet packing program shown in FIG. 6 to activate the tablet feeders 3. Tablets T are now discharged from the tablet feeders 3 through their discharge ports 18, dropped through the discharge channels 2 into the common hopper 6, and then packed in separate pouches by, the underlying packer 7.

During this operation, the control device 4 is monitoring the number of tablets T remaining in each tablet feeder 3. When the number of tablets T remaining in any of the tablet feeder 3 drops below the predetermined value, this tablet feeder 3, as well as the name of the tablets stored in this feeder, is indicated on the display device 36. In this state, by striking a marker 33 indicating the name of this type of tablets on a cartridge 15 that stores this type of tablets, and fitting this cartridge on the motor base 14 of one of the backup tablet feeders 30, the identification means reads the fact that the cartridge 15 has been fitted and the name of the tablets stored therein. It then executes the interrupt processing program to discharge tablets T by activating this backup tablet feeder 30. It is thus possible to keep on packing tablets without stopping the machine 1.

At the same time, the control device 4 activates the driving circuit 37 to turn on the light emitting diodes 40 of the tablet feeders 3 which is low in the stock of tablets, so that it is possible to take out without error the cartridges 15 which need refilling.

The cartridges 15 taken out are filled with tablets T while tablets T are being discharged from the backup tablet feeders 30. After filling them up with tablets, they are mounted back on the corresponding motor bases 14. At the same time, the number of tablets refilled in each cartridge 15 is inputted through the input means 34. It is easy to find the motor bases corresponding to the respective cartridges 15, because their light emitting diodes 40 are turned on.

Once the cartridges 15 are mounted in the body 5, the corresponding tablet feeders 30 in the body 5 are activated by the control device 4. Tablets are now discharged from the feeders 3 instead of from the backup feeders 30. At the same time, the light emitting diodes 40 are turned off by deactivating the driving circuit 37.

By providing the display devices for signaling the permission to resupply tablets, it is possible to prevent wrong cartridges 15 from being taken out.

When the number of tablets T remaining in this backup tablet feeder 30 drops below the predetermined value, another cartridge 15 filled with the same kind of tablets T should be fitted on any other empty backup tablet feeder 30. Even if no such empty backup tablet feeder is available, it is possible to keep on packing tablets by putting tablets T directly into the cartridge 15.

Since it is possible to resupply tablets T without pulling out the drawer units 9, there is no need to interrupt the tablet packing operation.

The greater the number of backup tablet feeders 30, the longer it is possible to pack tablets continuously.

For higher efficiency, cartridges 15 containing tablets that are used more frequently may be fitted in the backup tablet feeders 30 beforehand, because the tablet feeders 3 containing such tablets becomes empty more quickly.

Tablets that are used more frequently than others may be stored in some of the backup tablet feeders instead of tablet feeders 3 to supply them from the backup tablet feeders. With this arrangement, it is possible to increase the number of kinds of tablets stored in the machine at a time if extra kinds of tablets are stored in the now empty tablet feeders 3. It is also possible to reduce the entire size of the machine 1 by omitting these empty tablet feeders 3.

On the other hand, one or some of the backup tablet feeders 30 may be used to pack less frequently used tablets T that are not stored in the tablet feeders 3. In this case, a cartridge 15 containing such less frequently used tablets T and having a mark 33 with the name of these tablets stuck thereon is prepared. If required by prescriptions, these cartridges 15 are mounted on the motor base of a backup tablet feeder 30. Once fitted, the control device 4 reads the name of the tablets. Since these tablets are not stored in any of the tablet feeders 3 in the machine 1, the device 4 starts the interrupt processing program, so that the tablets T can be discharged from the backup tablet feeder 30. Thus, tablets can be packed continuously without interruption. If prescriptions require two or more kinds of tablets that are not stored in the tablet feeders 3, it is usually possible to replace the tablets T stored in the backup tablet feeders 30 with different kinds of tablets while the tablets in the tablet feeders are being processed without interrupting the packing of tablets, because such prescriptions are rare. Thus, it is possible to increase the number of kinds of tablets that can be processed at a time without increasing the number of backup feeders 30 and thus the size of the device 1. For simpler and more efficient packing of tablets, a plurality of cartridges 15 containing different kinds of tablets may be prepared beforehand so that they can be freely and easily replaced with one another.

FIG. 7 through FIG. 10 depict the second through fifth embodiments, respectively.

Figure 7:
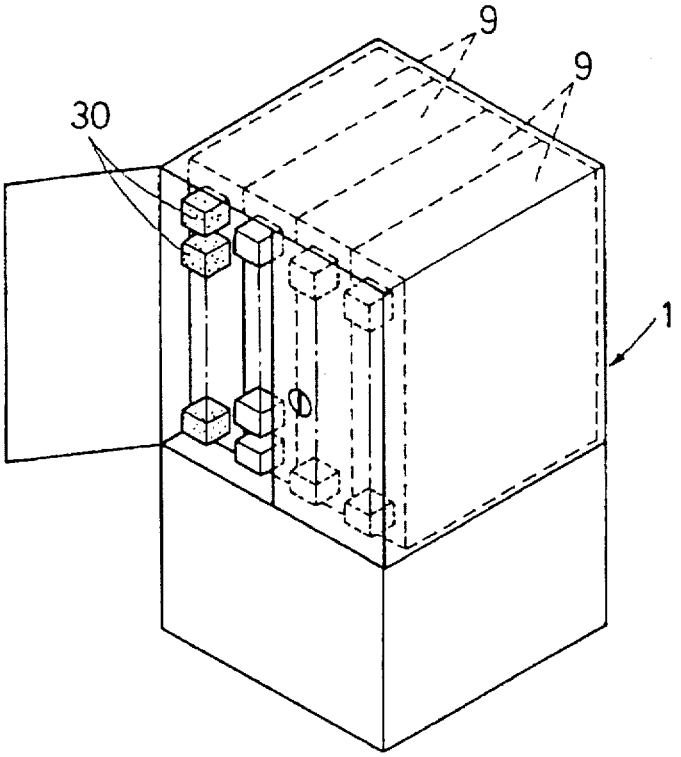
FIG. 7 is a perspective view of a second embodiment.
Figure 8:
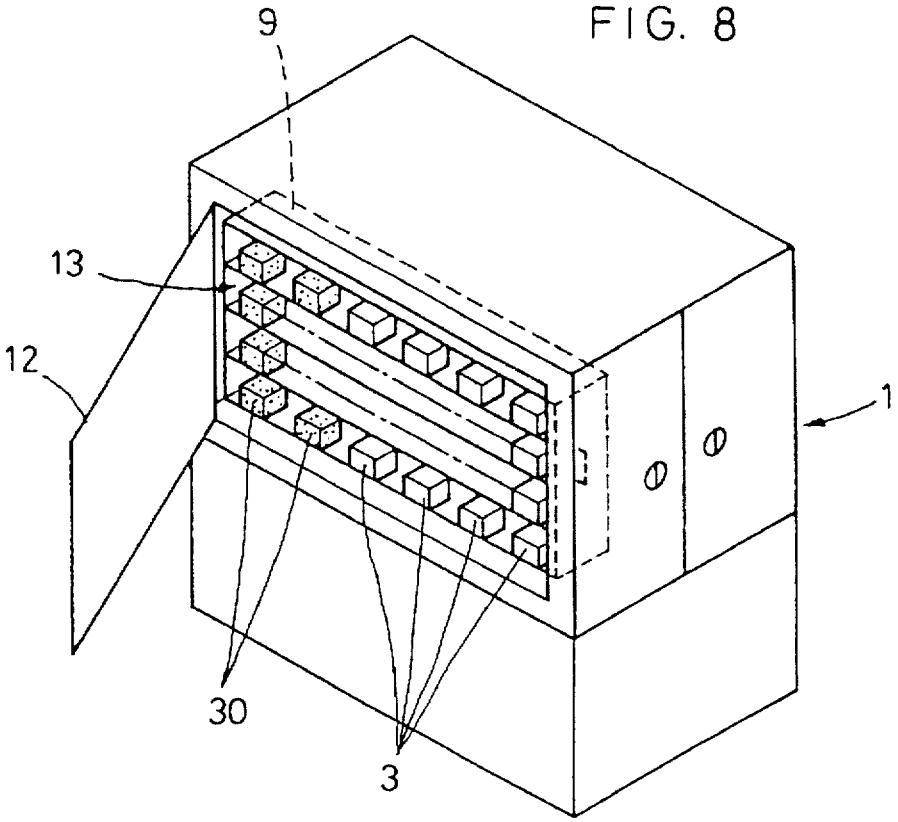
FIG. 8 is a perspective view of a third embodiment.

The device shown in FIG. 7 has drawer units 9 each having backup tablet feeders 30 and backup discharge channels 31 on the front side thereof. The device shown in FIG. 8 is provided with openings 13 in one side. A door 12 is provided near the openings 13. By opening the door 13, the tablet feeders 3 can be accessed from outside. The tablet feeders 3 of the drawer units, which are accessible from outside, are partially used as backup tablet feeders 30.

Figure 9:
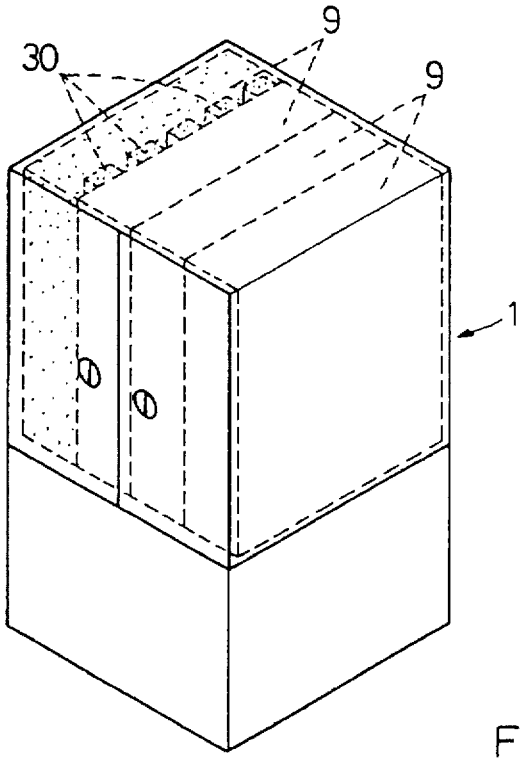
FIG. 9 is a perspective view of a fourth embodiment.

FIG. 9 shows as the fourth embodiment a device having four drawer units of which one is used as a backup tablet feeder. We will omit the description of the backup tablet feeder 1, control device 4, and display devices are identical to those of the first embodiment. Description is now made of the operation of this embodiment.

When the display device 36 of this tablet packing machine 1 indicates that the content of the tablets in any of the tablet feeders 3 is running low, an operator pulls out the drawer unit 9 carrying the backup tablet feeders 30, puts tablets T of the same kind as the tablets stored in the tablet feeder 3 indicated on the display device 36 in the corresponding backup tablet feeder 30, and pushes the drawer unit into the case 8. Then, the control device 4 discharges the tablets T in the backup tablet feeder 30. While the tablets T are being discharged from this feeder, the drawer unit 9 carrying the tablet feeder 3 whose stock of tablets is low is pulled out to resupply tablets T. When this is finished, the drawer unit 9 is pushed back into the case, and the weight data of the refilled tablets are inputted by the input means 34 to discharge tablets from the tablet feeders 3 again. By repeating this operation, tablets can be packed continuously.

Similar to the first embodiment, it is possible to use the backup tablet feeders 30 of this embodiment to pack frequently or less frequently prescribed tablets T which are not stored in the tablet feeders 3.

Figure 10:
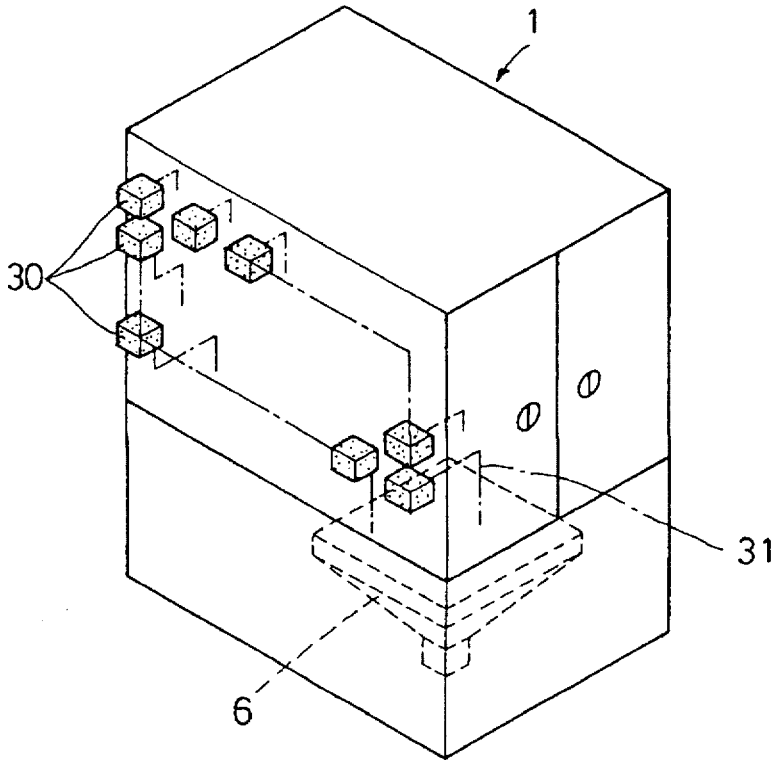
FIG. 10 is a perspective view of a fifth embodiment.

FIG. 10 shows as the fifth embodiment a modified embodiment of the fourth embodiment.

The device of this embodiment has the same number of backup tablet feeders 30 attached to one side of the case 8 as the number of the tablet feeders 3 of the drawer units 9. Thus, it is possible to use all the drawer units in the case 8 for the prescription of tablets T. Thus, it is possible to prescribe a greater number of kinds of tablets. Otherwise, this embodiment is structurally no different than the fourth embodiment, and so we do not describe them again.

Figure 11:
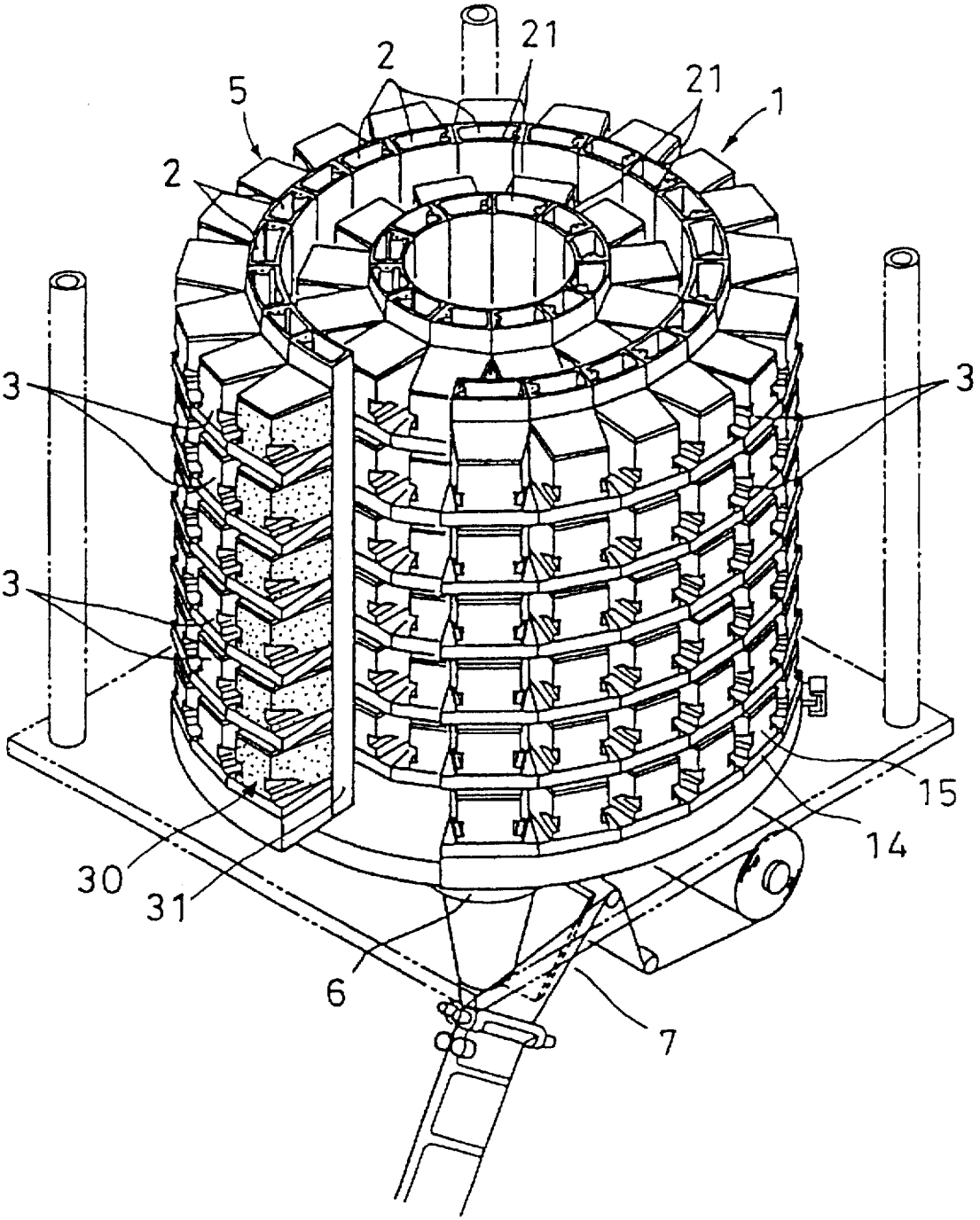
FIG. 11 is a perspective view of a sixth embodiment.

FIG. 11 depicts as the sixth embodiment a drum type tablet packing machine according to the present invention.

In this embodiment, cylindrical drums 19 and 20 carrying tablet feeders 3 are arranged along the circumference of the hopper 6. In this arrangement, since inoperative cartridges 15 can be freely detached and attached while discharging tablets without affecting the packing of tablets, it is possible to use part of the tablet feeders 3 as backup tablet feeders 30. The reminder of the tablet feeders 3 are provided with display means for indicating permission to resupply tablets in the form of light emitting diodes 40. The light emitting diodes 40 are provided on the motor bases 14 of the tablet feeders 3. The light emitting diodes 40 are of the same type as and are connected in the same manner as those in the first embodiment. Thus, their description is omitted.

When the display device 36 indicates that the tablets T in a certain tablet feeder 3 are low in stock, a cartridge 15 containing tablets T of the same name as the tablets indicated on the display is mounted on the motor base 14 of one of the backup tablet feeders 30. In this state, this backup tablet feeder 30 is actuated. While tablets are being discharged from this feeder, the tablet feeder 3 whose stock of tablets is low is replenished with tablets T. Since the light emitting diodes 40 of the tablet feeders which need to be refilled with tablets are turned on, it is possible to prevent the possibility of taking out wrong cartridges 15.

The tablet feeders 3 and the control device 4 are the same types used in the first embodiment. By sticking a marker 33 on the cartridge 15, the control device 4 can discharge tablets from the backup tablet feeder 30 by automatically executing the interrupt processing program. The refilled cartridges 15 can be mounted back on the corresponding tablet feeders 3, because the light emitting diodes 40 of these feeders 3 are turned on.

Then, it is possible to discharge tablets from the tablet feeder instead of from the backup tablet feeder 30 by inputting their weight data through the input means 34.

On the other hand, in the case of this tablet packing machine 1, it is possible to use the backup tablet feeders 30 to pack tablets T which are less frequently used and which are not stored in the tablet feeders 3. In this case too, a cartridge 15 containing such less frequently used tablets T and having a mark 33 with the name of these tablets stuck thereon is prepared. If required by prescriptions, this cartridge 15 is mounted on the motor base of a backup tablet feeder 30. Once fitted, the control device 4 reads the name of the tablets. Since these tablets are not stored in any of the tablet feeders 3 in the machine 1, the device 4 starts the interrupt processing program if these tablets are required in a prescription, so that the tablets T are discharged from the backup tablet feeder 30. Thus, tablets can be packed continuously without interruption. If prescriptions require two or more kinds of tablets that are not stored in the tablet feeders 3, it is usually possible to replace the tablets T stored in the backup tablet feeders 30 with different kinds of tablets while the tablets in the tablet feeders are being processed without interrupting the packing of tablets, because such prescriptions are rare.

Figure 12:
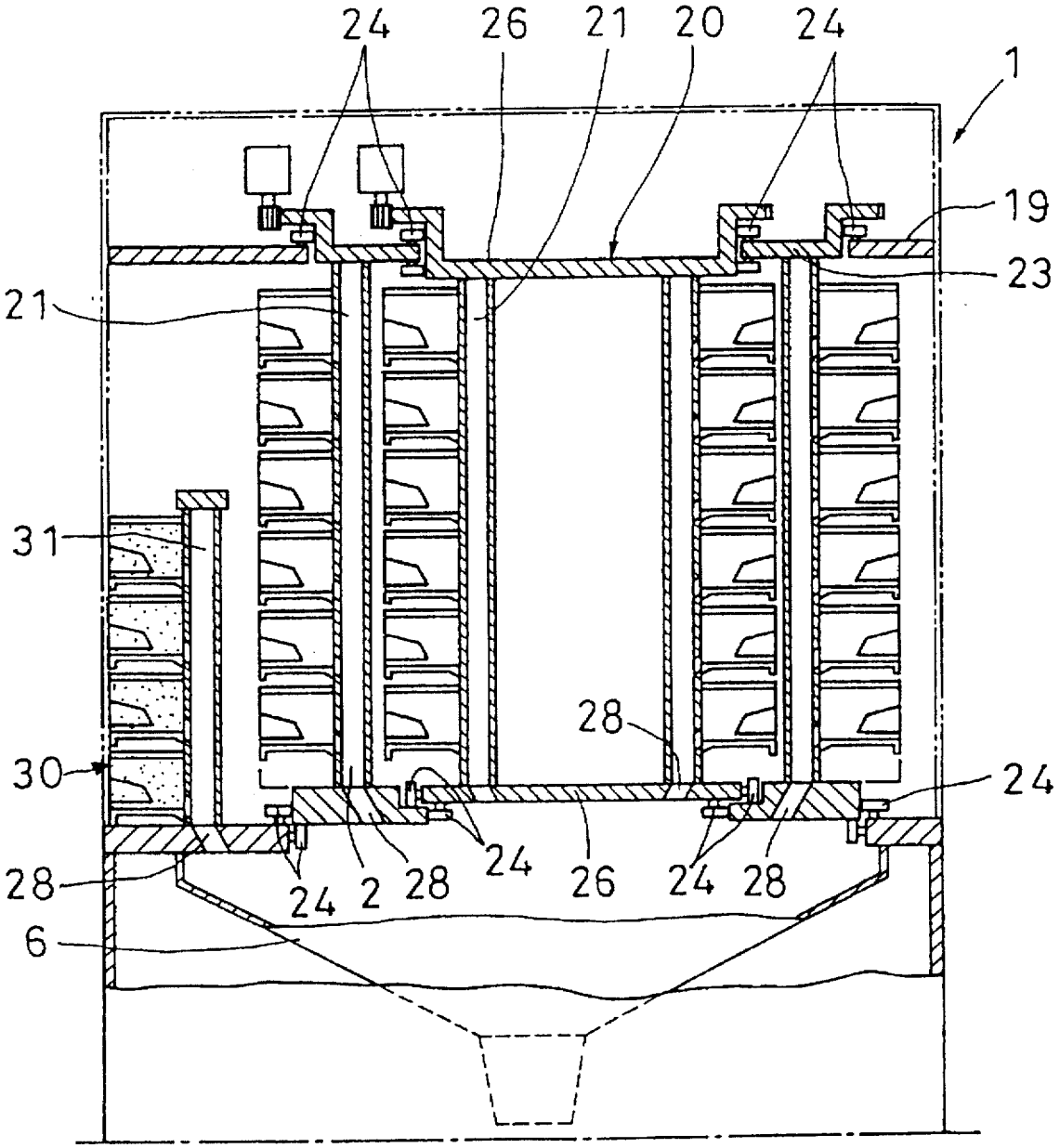
FIG. 12 is a vertical sectional view of a seventh embodiment.

FIG. 12 shows as the seventh embodiment a modified embodiment of the sixth embodiment.

In this embodiment, the backup tablet feeders 30 and the backup discharge channels 31 are provided separately from the drums 19, 20. Otherwise, this embodiment is identical structurally and functionally to the sixth embodiment, so that we omit any further description of this embodiment.

The tablet packing machine 1 having the backup tablet feeders 30 is not limited to the types of the embodiments but may be of the type that uses part of the tablet feeders of the drawer units as the backup tablet feeders.

In the embodiment, the light emitting diode for indicating permission to resupply tablets are mounted on the motor bases of the tablet feeders. But if drawer type tablet feeders are used, they may be provided on shelves on which the tablet feeders are mounted.

Also, such display devices are not limited to light emitting diodes but may be light bulbs, fluorescent tubes, EL elements. Such display devices may be of the type that emit light continuously or intermittently. If intermittent light is used, LED or LCD panels capable of indicating the number of tablets stored in each tablet feeder in real time by blinking may be mounted on each tablet feeder.

Figure 13:
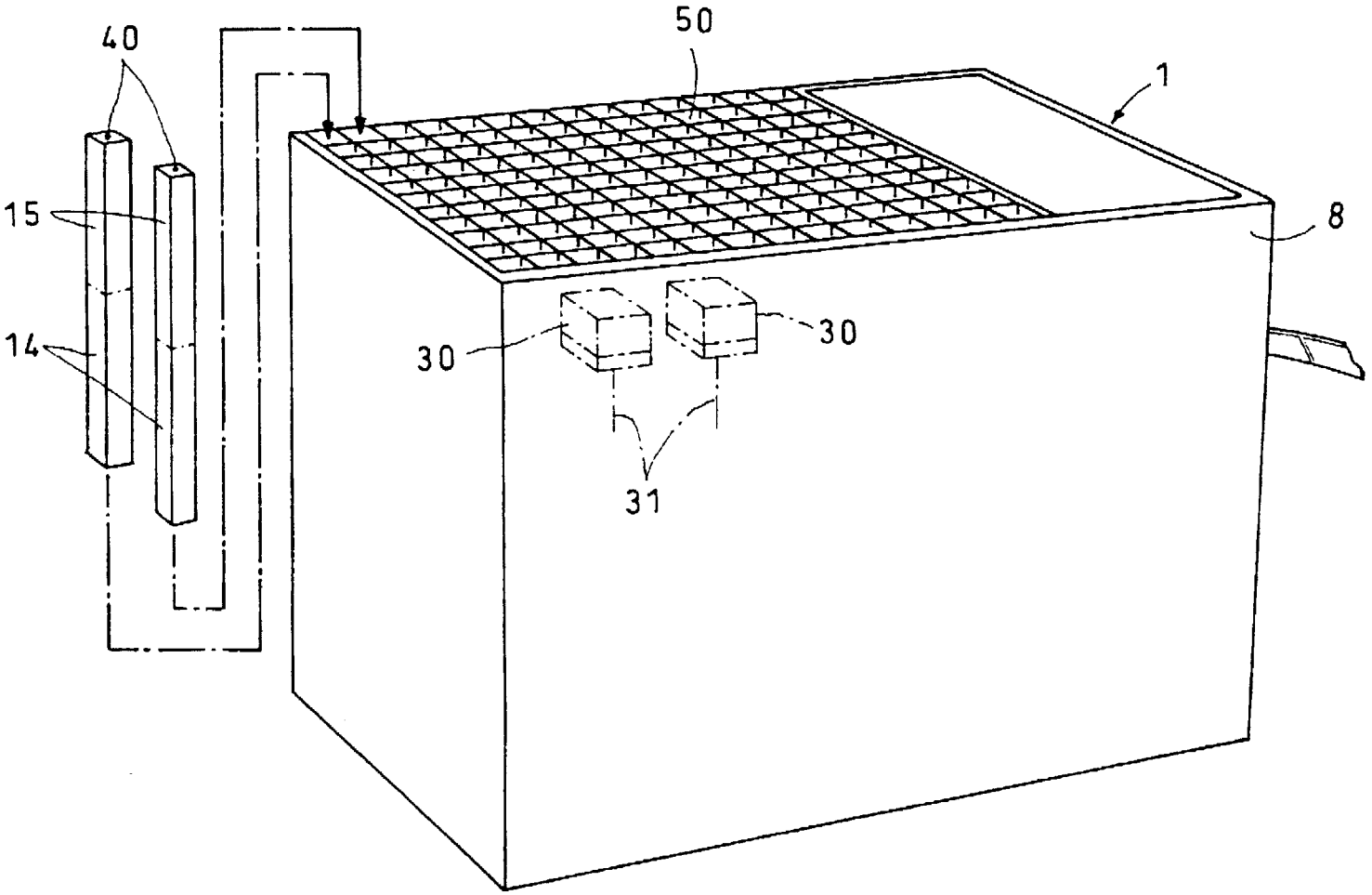
FIG. 13 is a perspective view of an eighth embodiment.
Figure 14:
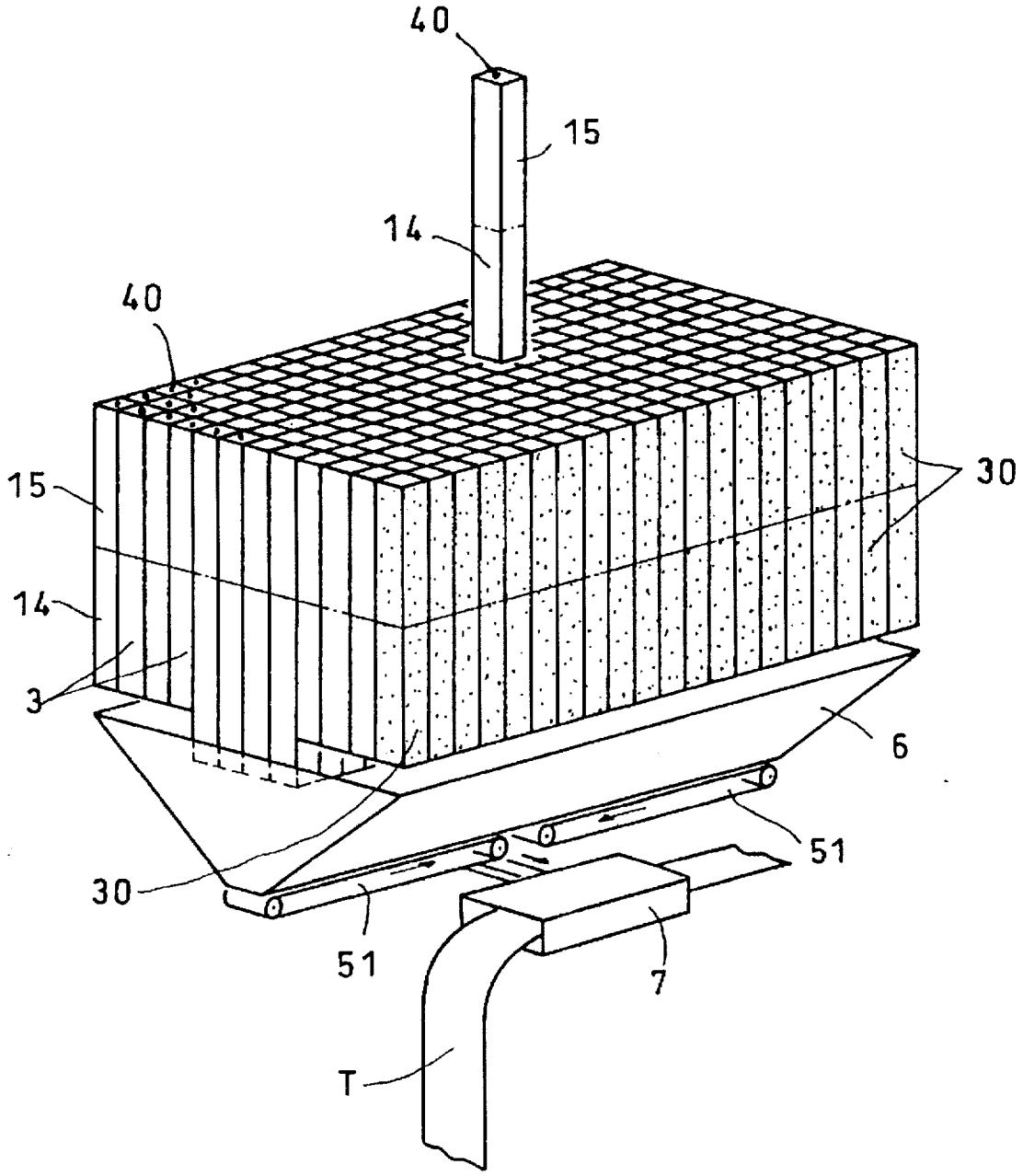
FIG. 14 is a schematic view showing the structure of the eighth embodiment.
Figure 15:
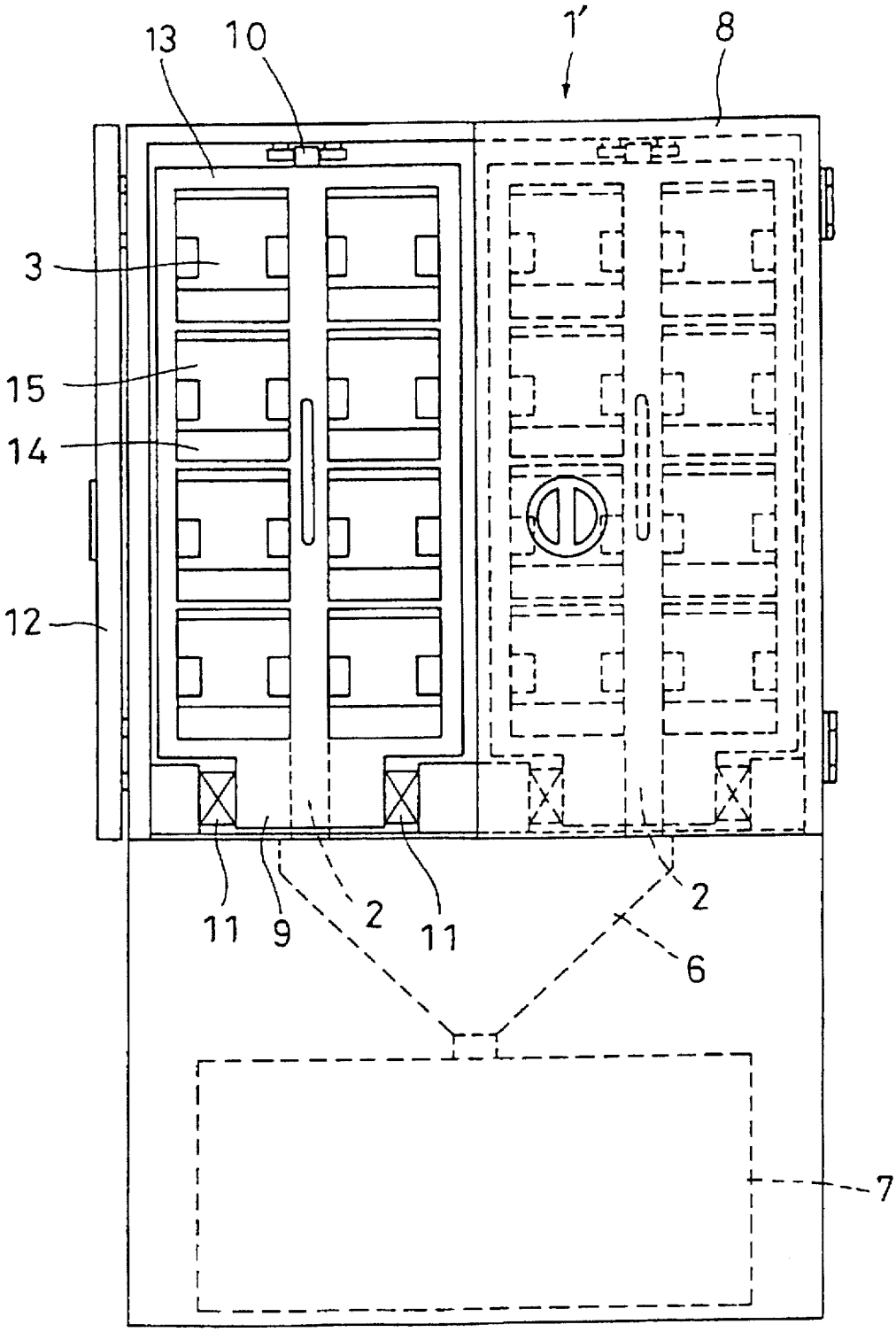
FIG. 15 PRIOR ART
FIG. 15 is a front view of a conventional drawer type tablet packing machine.
Figure 16:
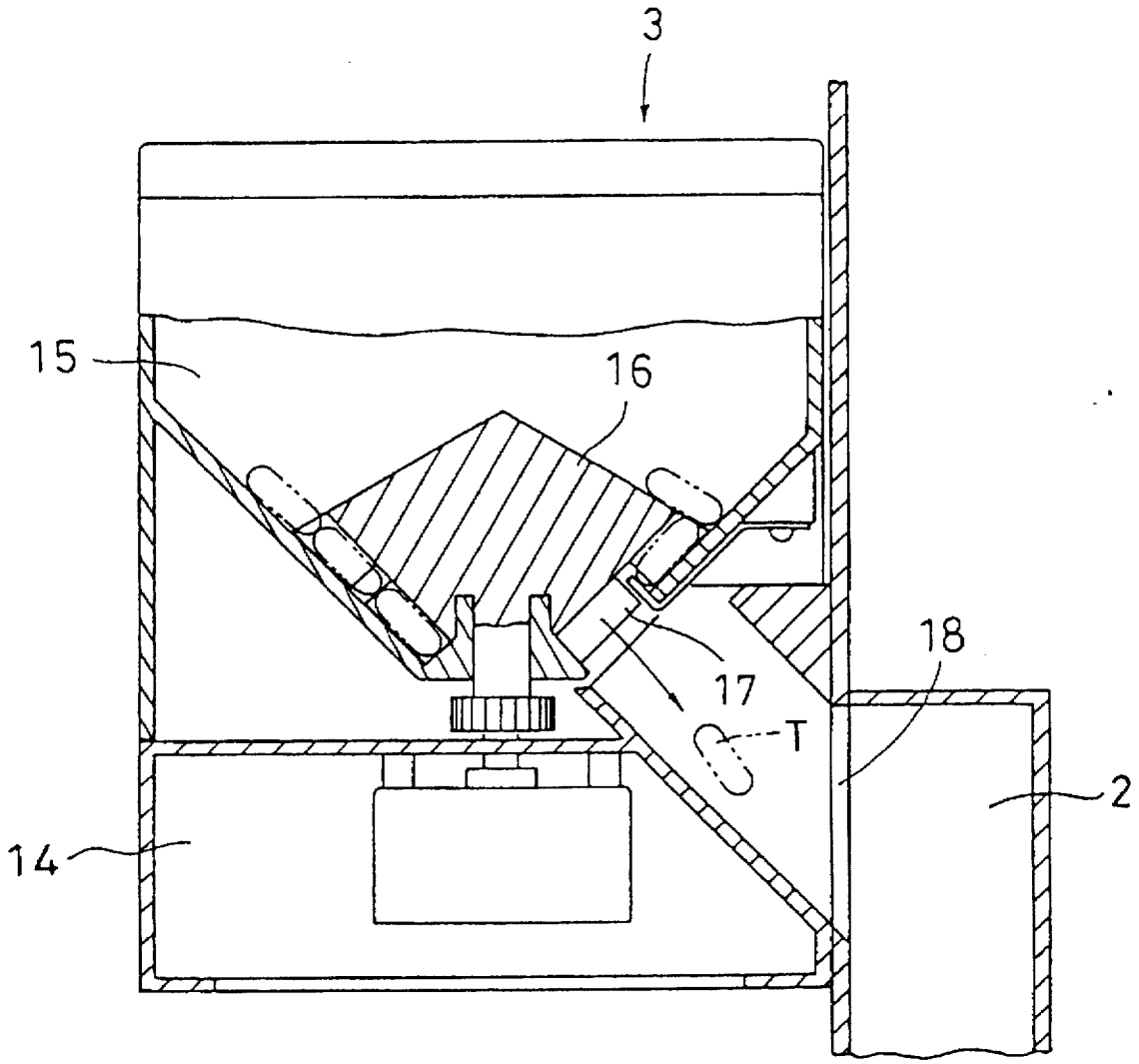
FIG. 16 is a vertical sectional view of the tablet feeder.
Figure 17:
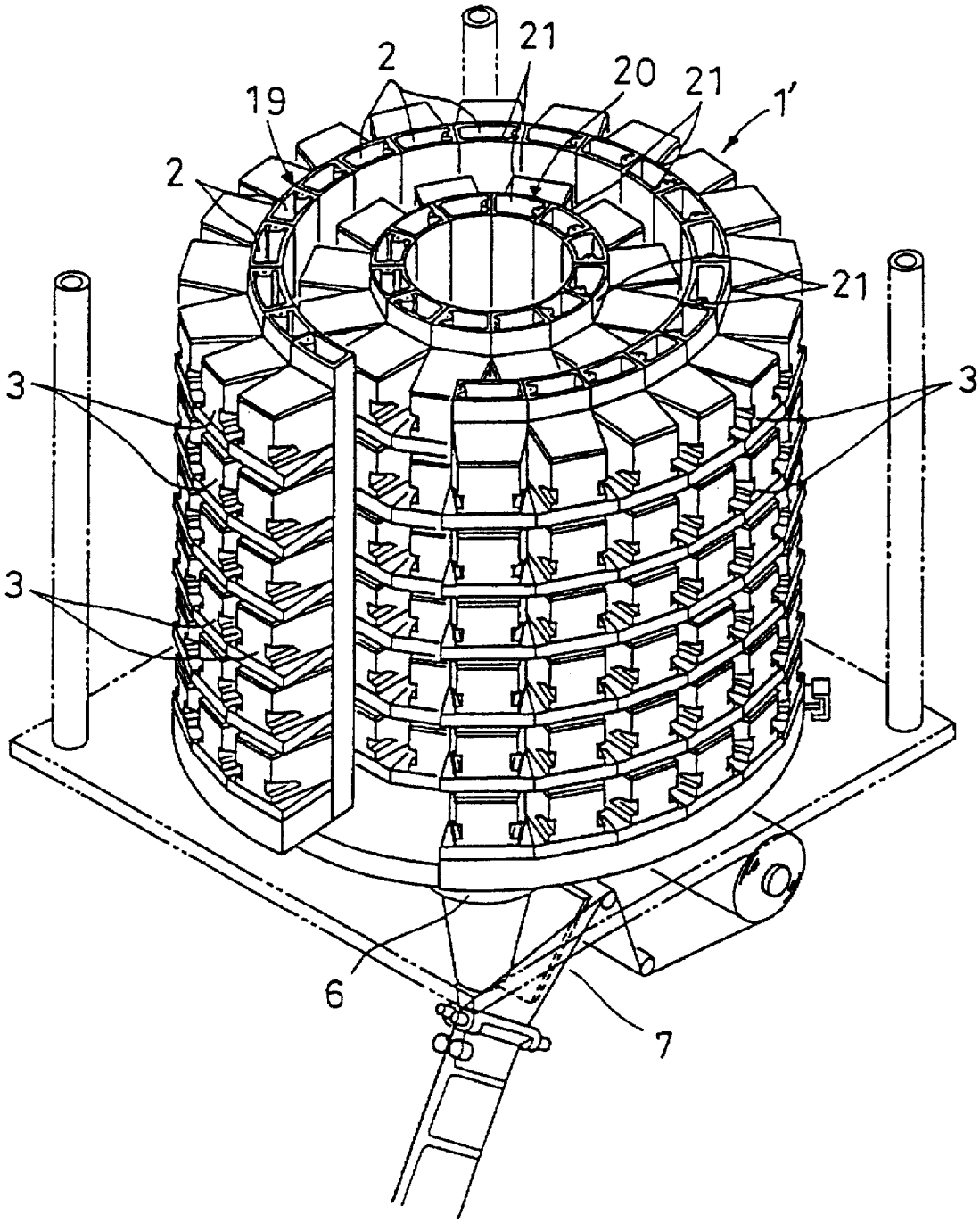
FIG. 17 PRIOR ART
FIG. 17 is a perspective view of a conventional drum type tablet packing machine.
Figure 18:
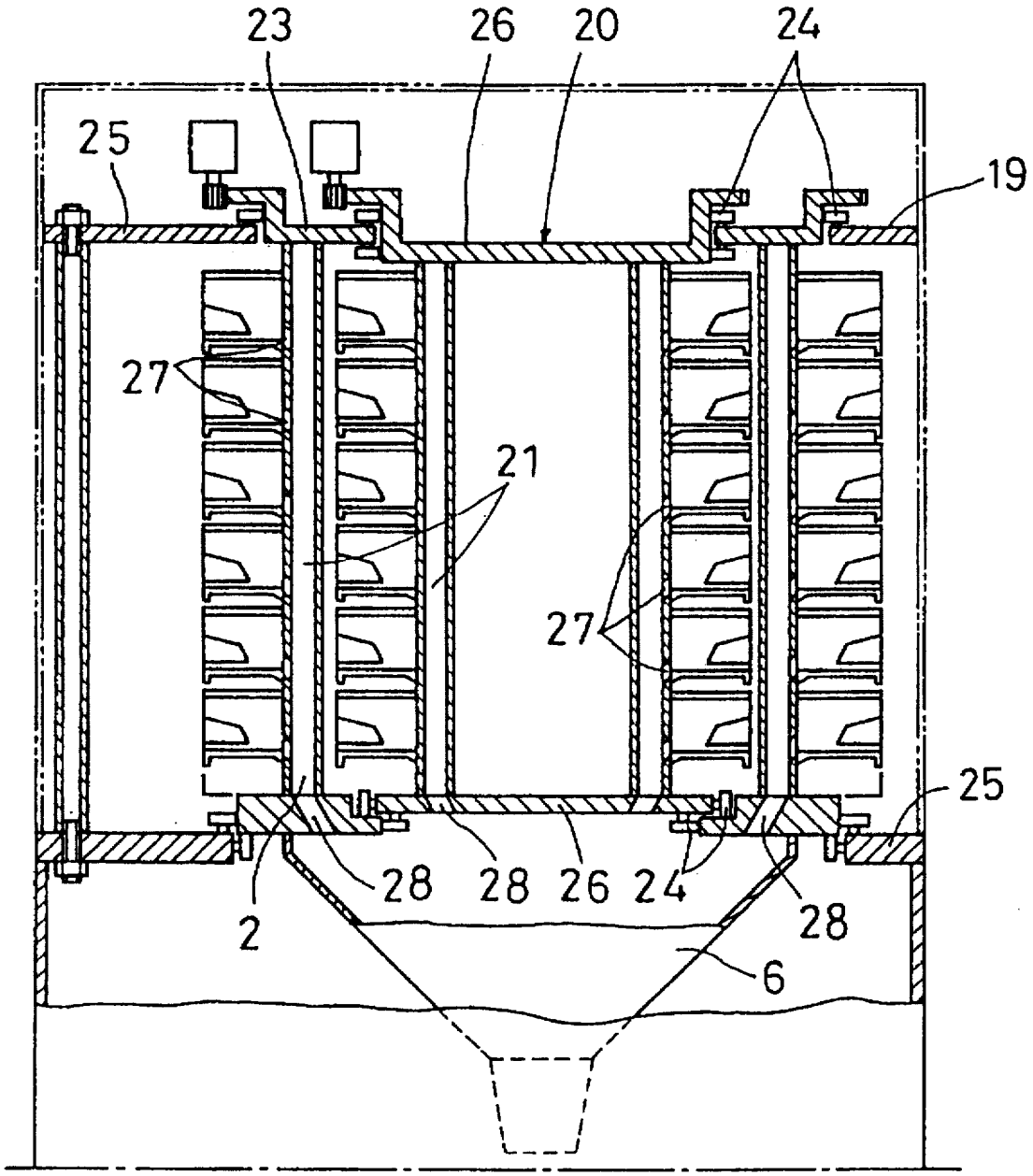
FIG. 18 is a vertical sectional view of FIG. 16.
Figure 19:
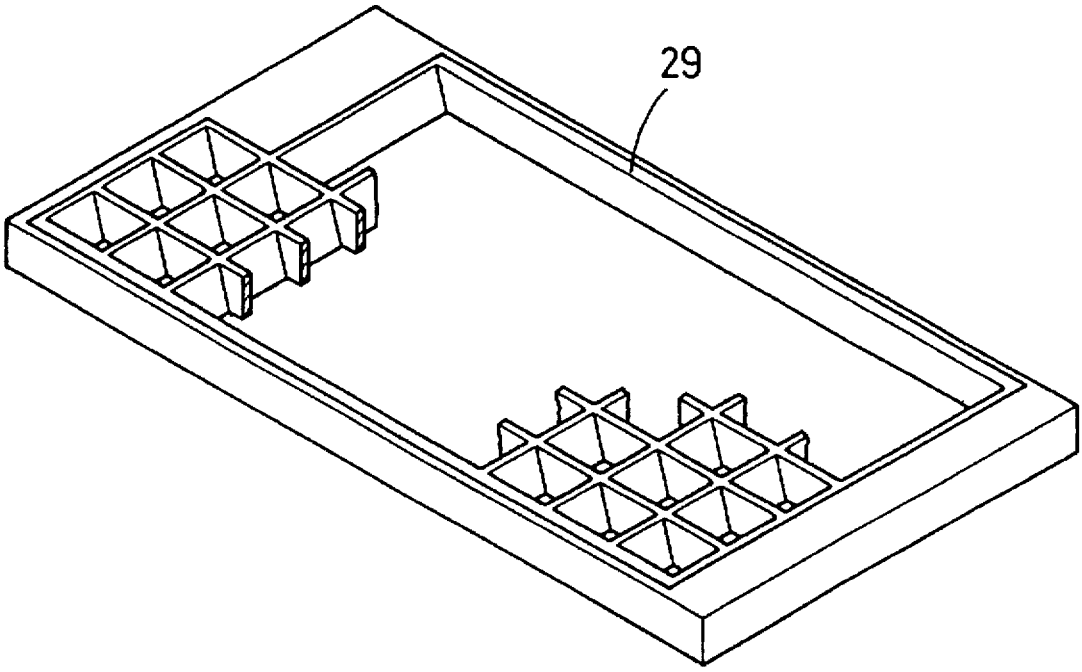
FIG. 19 is a perspective view of a detachable tablet supplier.

FIG. 13 and 14 show a tablet packing machine of the eighth embodiment.

As shown in FIG. 13, the interior of the case 8 is partitioned into a plurality of feeder housing cells 50. Each cell 50 accommodates a tablet feeder 3 or a backup tablet feeder 30 over the hopper 6. In this embodiment, as shown in FIG. 14, the cells in the frontmost one row accommodate backup tablet feeders 30.

The tablet feeders 3 and 30 each comprise a motor base 14 and a cartridge 15 as in the first embodiment, and are provided (though not shown) with a display 33 for displaying drug data and a read means 32 for reading these data. Further, the tablet feeders 3 in the case 8 have each a light emitting diode 40 on the top for indicating the permission to refill tablets. The tablet feeders 3 and 30 are so slim that it is possible to provide many of them over the hopper 6 and thus to pack many different kinds of tablets T. The tablet feeders 3 and 30 are connected to a control device (not shown) in the case 8. The control device controls the respective tablet feeders 3, 30 based on prescription data in the same manner as in the first embodiment.

Under the hopper 6 is a tablet packer 7 for packing tablets T discharged from the tablet feeders 3, 30 into the opening of the hopper 6. In this embodiment, the hopper 6 has a rectangular discharge port under which is provided a conveyor 51 for supplying tablets T into the tablet packer 7.

We will omit the description of the operation of this embodiment because it is substantially the same as in the first embodiment.

In this embodiment, as shown by chain line in FIG. 13, backup feeders 30 may be mounted on the outer wall of the case 8 so that tablets T can be partially dropped into the hopper 6 from these backup feeders 30 through backup discharge channels 31.

As discussed above, the tablet packing machine according to the present invention has backup tablet feeders and backup discharge channels. When the stock of the tablets in any of the tablet feeders becomes low, it is possible to resupply tablets without interrupting the packing of tablets.

It is possible to pack less frequently used tablets without the need of a detachable tablet feeder. Thus, tablets can be prescribed more efficiently.

In the third invention, it is possible to read the names of the tablets. Thus, the backup tablet feeders and the tablet feeders can be automatically changed over simply by fitting cartridges for the tablet feeders. This makes it possible to improve the efficiency of the packing of tablets. Also, it is possible to reduce the possibility of tablet setting errors.

The tablet packing machine further comprises display devices for indicating permission to resupply tablets by displaying that the discharge of tablets have been changed over to the backup tablet feeders. Thus, when resupplying tablets, it is possible to prevent wrong cartridges from being taken out. Also, while taking out cartridge for refilling, it is possible to continuously pack tablets.

Also, the refilled cartridges can be set in the right tablet feeders because the display devices of these feeders are turned on.

The present invention concerns a drawer type tablet packing machine. In this arrangement, more frequently prescribed tablets are supplied with the backup tablet feeders. Thus, it is possible to use the empty tablet feeders in the machine to store tablets of different kinds and thus to increase the kinds of tablets which can be prescribed with the machine. Or such empty tablet feeders may be removed from the machine to reduce the entire size of the machine.

According to the present invention, it is possible to increase the kinds of prescribable tablets without increasing the number of backup tablet feeders. Namely, one tablet feeder is used to process more than one kind of tablets. Thus, it is possible to pack many kinds of tablets without increasing the size of the machine.

What is claimed is:

1. A tablet packing machine comprising:

a plurality of primary tablet feeders;

a plurality of vertically extending discharge channels communicating with said plurality of primary tablet feeders, respectively;

a plurality of backup tablet feeders;

a plurality of backup discharge channels communicating with said plurality of backup tablet feeders, respectively;

a hopper disposed below said plurality of discharge channels and said plurality of backup discharge channels for receiving tablets from said plurality of primary tablet feeders and said plurality of backup feeders;

a packing device communicating with an outlet portion of said hopper; and a control device operatively connected to said plurality of primary tablet feeders and said plurality of backup tablet feeders such that, upon depletion of a predetermined amount of tablets in one of said primary tablet feeders, said control device automatically deactivates one of said primary tablet feeders and activates a corresponding one of said backup feeders.

2. The tablet packing machine as claimed in claim 1, wherein each of said primary and backup tablet feeders comprises:

a motor base operatively connected to said control device and having reading means for reading data; and a tablet storage cartridge detachably mounted on said motor base and having an identifier, which is indicative of the contents contained in said tablet storage cartridge, wherein, when said tablet storage cartridge is mounted on said motor base, said reading means reads said identifier and transmits a signal representative of the contents of said tablet storage cartridge to said control device.

3. The tablet packing machine as claimed in claim 2, wherein said reading means comprises a plurality of light sensors and said identifier means comprises a binary-coded marker.

4. The tablet packing machine as claimed in claim 1, wherein each of said plurality of primary tablet feeders includes a display device which indicates when said one backup tablet feeder has been activated so that said depleted tablet feeder may be resupplied.

5. The tablet packing machine as claimed in claim 4, wherein said display device comprises a light emitting diode.

6. The tablet packing machine as claimed in claim 1, further comprising a case enclosing said plurality of primary tablet feeders, said hopper, and said packing device.

7. The tablet packing machine as claimed in claim 6, wherein backup tablet feeders are mounted on an outside surface of said case.

8. A tablet packing machine comprising:

a hopper having a hopper inlet and a hopper outlet;

a plurality of primary tablet feeders in communication with said hopper inlet;

a plurality of backup tablet feeders in communication with said hopper inlet;

a control device for controlling said plurality of primary tablet feeders in accordance with prescription data and automatically deactivating one of said primary tablet feeders and activating a corresponding one of said plurality of backup tablet feeders upon depletion of a predetermined amount of tablets in at least one of said primary tablet feeders; and a tablet packer disposed adjacent said hopper outlet for packing tablets discharged from said hopper.

9. The tablet packing machine as claimed in claim 8, wherein each of said plurality of primary and backup tablet feeders comprises:

a motor base operatively connected to said control device and having reading means for reading data; and a tablet storage cartridge detachably mounted on said motor base and having an identifier, which indicates the contents contained in said tablet storage cartridge, wherein, when said tablet storage cartridge is mounted on said motor base, said reading means reads said identifier and transmits a signal representative of the contents of said tablet storage cartridge to said control device.

10. The tablet packing machine as claimed in claim 9, wherein said reading means comprises a plurality of light sensors and said identifier comprises a binary-coded marker.

11. The tablet packing machine as claimed in claim 8, wherein each of said plurality of tablet feeders includes a display device which indicates when said one backup tablet feeder has been activated so that said depleted tablet feeder may then be resupplied.

12. The tablet packing machine as claimed in claim 11, wherein said display device comprises a light emitting diode.

* * * * *